US010385439B2

(12) United States Patent
Shimizu et al.

(10) Patent No.: US 10,385,439 B2
(45) Date of Patent: Aug. 20, 2019

(54) NITRIDING PROCESS METHOD OF STEEL MEMBER

(71) Applicants: Dowa Thermotech Co., Ltd., Tokyo (JP); Honda Motor Co., Ltd., Tokyo (JP)

(72) Inventors: Yuichiro Shimizu, Tokyo (JP); Susumu Maeda, Saitama (JP); Atsushi Kobayashi, Bangkok (TH)

(73) Assignee: DOWA THERMOTECH CO., LTD., Tokyo (JP)

( * ) Notice: Subject to any disclaimer, the term of this patent is extended or adjusted under 35 U.S.C. 154(b) by 691 days.

(21) Appl. No.: 15/026,158

(22) PCT Filed: Sep. 30, 2014

(86) PCT No.: PCT/JP2014/076178

§ 371 (c)(1),
(2) Date: Mar. 30, 2016

(87) PCT Pub. No.: WO2015/046593

PCT Pub. Date: Apr. 2, 2015

(65) Prior Publication Data

US 2016/0244869 A1 Aug. 25, 2016

(30) Foreign Application Priority Data

Sep. 30, 2013 (JP) ..... 2013-204786

(51) Int. Cl.
*C23C 8/26* (2006.01)
*C21D 9/32* (2006.01)
(Continued)

(52) U.S. Cl.
CPC ..... *C23C 8/26* (2013.01); *C21D 1/06* (2013.01); *C21D 9/0056* (2013.01); *C21D 9/32* (2013.01); *C23C 8/80* (2013.01)

(58) Field of Classification Search
CPC .... C23C 8/26; C23C 8/80; C21D 1/06; C21D 9/32; C21D 9/0056
See application file for complete search history.

(56) References Cited

U.S. PATENT DOCUMENTS 6,093,263 A 6/2000 Kobayashi et al.

FOREIGN PATENT DOCUMENTS

JP S53-001142 A 1/1978
JP H11-072159 A 3/1999
(Continued)

OTHER PUBLICATIONS

International Search Report issued in Application No. PCT/JP2014/076178, dated Dec. 16, 2014.
(Continued)

*Primary Examiner* — Colleen P Dunn
*Assistant Examiner* — Anthony M Liang
(74) *Attorney, Agent, or Firm* — Michael Best & Friedrich LLP

(57) ABSTRACT

A first nitriding process step is performed in which a steel member is subjected to a nitriding process in a nitriding gas atmosphere having a nitriding potential with which a nitride compound layer having a γ' phase or an ε phase is generated, and thereafter a second nitriding process step is performed in which the steel member is subjected to a nitriding process in a nitriding gas atmosphere having a nitriding potential lower than the nitriding potential in the first nitriding process step, to thereby precipitate the γ' phase in the nitride compound layer. It is possible to generate the nitride compound layer having a desired phase mode uniformly all over a component to be treated and to manufacture a nitrided steel member high in pitting resistance and bending fatigue strength.

5 Claims, 2 Drawing Sheets

| ITEM | BEFORE LOADING | LOAD | NITRIDING PROCESS | | N2 GAS COOLING |
|---|---|---|---|---|---|
| FURNACE TEMPERATURE | 600 | | 600 | | - |
| | | | | | |
| TIME (min) | | - | 60 | 60 | 60 |
| $N_2$ (L/min) | 30 | 30 | - | - | 84 (COOLING CHAMBER) |
| $NH_3$ (L/min) | 120 | 120 | 120 | 60 | - |
| $H_2$ (L/min) | - | - | ADJUST | ADJUST | - |

(51) Int. Cl.

| | |
|---|---|
| ***C21D 1/06*** | (2006.01) |
| ***C23C 8/80*** | (2006.01) |
| ***C21D 9/00*** | (2006.01) |

(56) References Cited

FOREIGN PATENT DOCUMENTS

| | | | | |
|---|---|---|---|---|
| JP | 2002-241922 | A | | 8/2002 |
| JP | 2004-183099 | A | | 7/2003 |
| JP | 2007-238969 | A | | 9/2007 |
| JP | 2007238969 | A | * | 9/2007 |
| JP | 2013-221203 | A | | 10/2013 |

OTHER PUBLICATIONS

Dieter Liedtke et al., "Nitriding and Nitrocarburizing on Iron Materials", 1st edition, 1st print, Aug. 30, 2011, pp. 11, 12, 37 to 39, 131 to 133 & 137, AGNE Gijutsu Center Inc., Japan.

* cited by examiner

| ITEM | BEFORE LOADING | LOAD | NITRIDING PROCESS | | N2 GAS COOLING |
|---|---|---|---|---|---|
| FURNACE TEMPERATURE | 600 | | 600 | | - |
| | | | | | |
| TIME (min) | | - | 60 | 60 | 60 |
| $N_2$ (L/min) | 30 | 30 | - | - | 84 (COOLING CHAMBER) |
| $NH_3$ (L/min) | 120 | 120 | 120 | 60 | - |
| $H_2$ (L/min) | - | - | ADJUST | ADJUST | - |

NITRIDING PROCESS METHOD OF STEEL MEMBER

TECHNICAL FIELD

Cross Reference to Related Application

This application is based upon and claims the benefit of priority from Japanese Patent Application No. 2013-204786 filed on Sep. 30, 2013; the entire contents of which are incorporated herein by reference.

The present invention relates to a nitriding process method of a steel member, the method forming a nitride compound layer on a surface of the steel member by a nitriding process

BACKGROUND ART

Steel members such as gears used in automobile transmissions are required to be high in pitting resistance and bending fatigue strength, and to meet such requirement, increasing strength by a carburizing process or a nitriding process has been in practice as a method to strengthen steel members such as gears.

It has been conventionally known that, for improving pitting resistance and bending fatigue strength of a steel member, it is effective to generate an iron nitride compound layer whose main component is a γ' phase, on a surface of the steel member by a nitriding process, as described in, for example, Patent Document 1.

Further, as a nitriding process method capable of making nitrogen contained in a steel member uniformly from its surface layer up to deep portion in a short time, Patent Document 2 describes that, after a nitriding process is performed in, for example, a 100% NH3 atmosphere in a heating furnace, a nitriding process is performed under a lower NH3 gas concentration than the above, for example, 50% and a 50% N2 gas concentration.

PRIOR ART DOCUMENT

Patent Document

[Patent Document 1] Japanese Patent Application No. 2012-095035

[Patent Document 2] Japanese Laid-open Patent Publication No. 2007-238969

DISCLOSURE OF THE INVENTION

Problems to Be Solved by the Invention

In order to generate the γ' phase on the surface layer, it is necessary for a NH3 partial pressure in a furnace during the nitriding process to be low, but the method described in Patent Document 1 has restriction that a flow velocity of nitriding process gas in the furnace needs to be 1 m/sec or higher in order to uniformly form the nitride compound layer. Further, if a component has a complicated shape, it has been difficult to generate the nitride compound layer uniformly over positions of the component. Further, in mass production, there has been a problem about productivity due to a great thickness variation among the nitride compound layers in a lot.

Further, Patent Document 2 describes that its nitriding process method achieves the uniform nitriding in a short time, but does not mention a phase change of the compound and so on in this method.

It is an object of the present invention to provide a method of manufacturing a nitrided steel member high in pitting resistance and bending fatigue strength, the method being free from restriction of wind velocity and capable of generating a nitride compound layer having a desired phase mode, uniformly all over a component to be treated, even if it is a mass-produced component to be treated.

Means for Solving the Problems

To solve the aforesaid problems, the present invention provides a nitriding process method of a steel member, wherein a first nitriding process step is performed in which the steel member is subjected to a nitriding process in a nitriding gas atmosphere having a nitriding potential with which a nitride compound layer having a γ' phase or an ε phase is generated, and thereafter a second nitriding process step is performed in which the steel member is subjected to a nitriding process in a nitriding gas atmosphere having a nitriding potential lower than the nitriding potential in the first nitriding process step, to thereby precipitate the γ' phase in the nitride compound layer.

The first nitriding process step may be performed in a nitriding gas atmosphere having a 0.6 to 1.51 nitriding potential, and the second nitriding process step may be performed in a nitriding gas atmosphere having a 0.16 to 0.25 nitriding potential.

Effect of the Invention

According to the present invention, it is possible to generate a nitride compound layer having a desired phase mode, uniformly all over a component to be treated, even if it is a mass-produced component to be treated, without any restriction of wind velocity, and to manufacture a nitrided steel member high in pitting resistance and bending fatigue strength.

MODE FOR CARRYING OUT THE INVENTION

Hereinafter, an embodiment of the present invention will be described with reference to the drawings.

In the present invention, a steel member is subjected to a gas nitriding process, whereby an iron nitride compound layer whose main component is a γ' phase is formed on a surface of the steel member (base metal).

Figure 1:
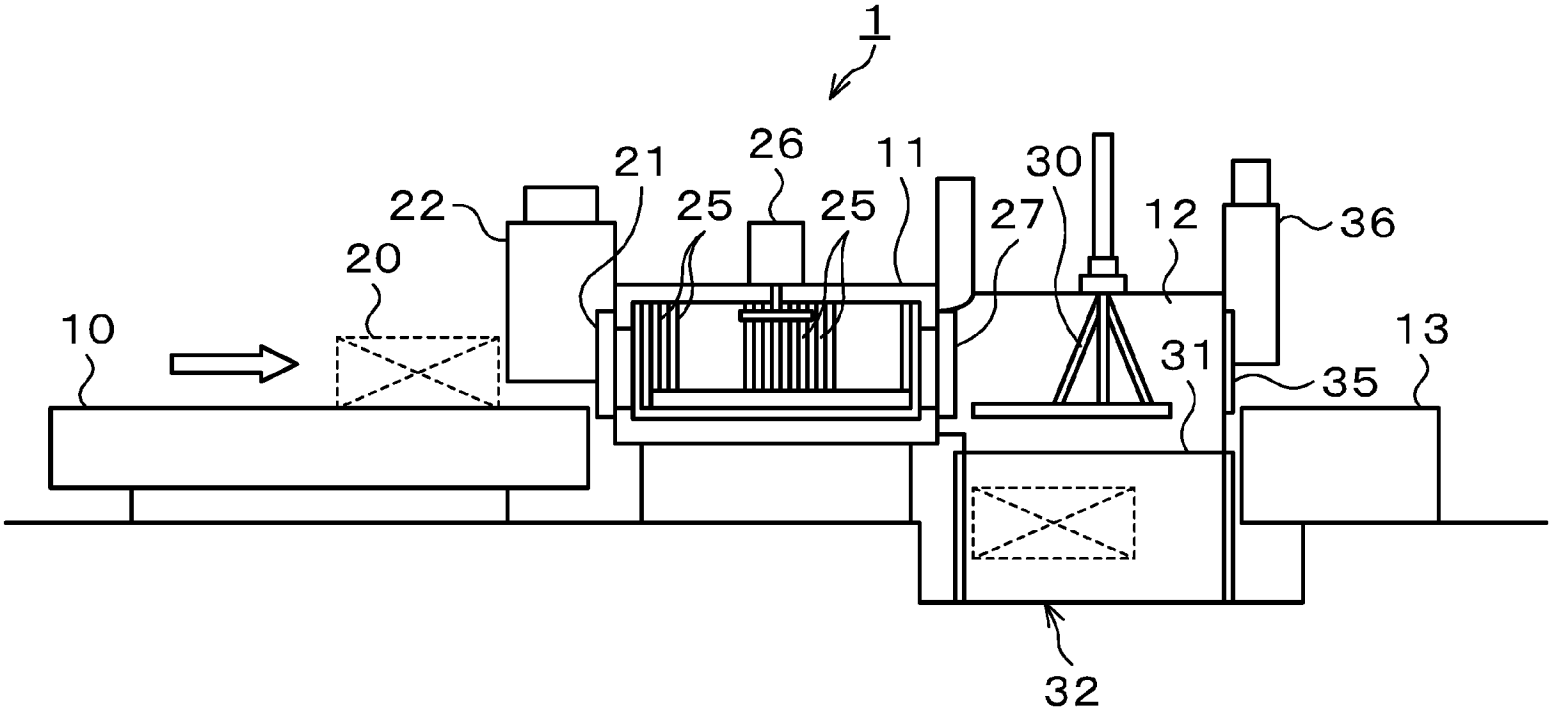
FIG. 1 is an explanatory view illustrating an example of the structure of a heat treatment apparatus.

A heat treatment apparatus 1, for example, illustrated in FIG. 1 is used for the nitriding process applied to the steel member being a treatment target. As illustrated in FIG. 1, the heat treatment apparatus 1 has a loading unit 10, a heating chamber 11, a cooling chamber 12, and an unloading conveyor 13. The steel member made of a carbon steel material for mechanical structure or an alloy steel material for mechanical structure, such as, for example, a gear used in an automatic transmission is housed in a case 20 placed on the loading unit 10. An entrance hood 22 including an openable/closable door 21 is attached to an entrance side (left side in FIG. 1) of the heating chamber 11.

Heaters 25 are disposed in the heating chamber 11. Nitriding process gas made up of N2 gas, NH3 gas, and H2 gas is introduced into the heating chamber 11, the nitriding process gas is heated to a predetermined temperature by the heaters 25, and the steel member loaded into the heating chamber 11 is subjected to the nitriding process. A fan 26 for stirring the process gas in the heating chamber 11 and keeping the heating temperature of the steel member uniform is fit in a ceiling of the heating chamber 11. An openable/closable intermediate door 27 is attached to an exit side (right side in FIG. 1) of the heating chamber 11.

An elevator 30 which lifts up and down the case 20 housing the steel member is installed in the cooling chamber 12. An oil tank 32 storing cooling oil 31 is installed in a lower part of the cooling chamber 12. An exit food 36 including an openable/closable door 35 is attached to an exit side (right side in FIG. 1) of the cooling chamber 12.

In the above-described heat treatment apparatus 1, the case 20 housing the steel member is loaded into the heating chamber 11 from the loading unit 10 by a pusher or the like. Incidentally, it is preferable to pre-clean the treatment target (steel member to be nitrided) prior to the nitriding process, in order to remove dirt and oil therefrom. The pre-cleaning is preferably, for example, vacuum cleaning which degreases and dries the treatment target by dissolving and replacing oil and so on by a hydrocarbon-based cleaning liquid and vaporizing it, alkaline cleaning which degreases the treatment target by an alkaline cleaning liquid, or the like.

Then, after the case 20 housing the steel member thus pre-treated is loaded into the heating chamber 11, the process gas is introduced into the heating chamber 11. Further, the process gas introduced into the heating chamber 11 is heated to the predetermined temperature by the heaters 25, and the steel member loaded into the heating chamber 11 is subjected to the nitriding process while the process gas is stirred by the fan 26. The heat treatment apparatus in FIG. 1 is an example, and the heating chamber and the cooling chamber may be a process chamber in the same space, and the steel member having been heat-treated may be air-cooled by gas. Further, the heating chamber may be divided into two, and later-described two-stage nitriding process steps may be performed in different heating chambers.

Figures 2, 3:
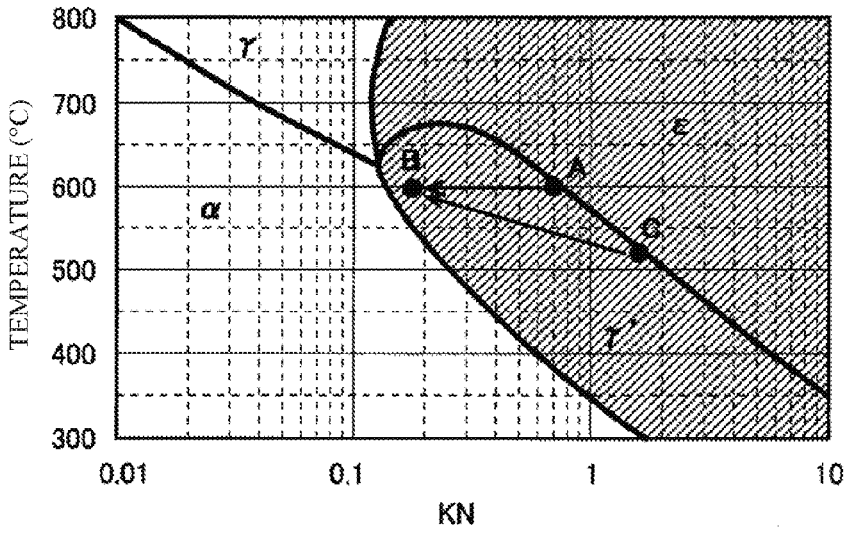
FIG. 2 is an explanatory process chart of a nitriding process.
FIG. 3 is a chart illustrating phases of a compound which are generated depending on KN and temperature.

FIG. 2 illustrates one embodiment of the nitriding process steps, and hereinafter the nitriding process will be described with reference to FIG. 2. Before the steel member is loaded, for example, the N2 gas and the NH3 gas are introduced into the heating chamber 11 at 30 L/min and 120 L/min respectively, and the inside of the heating chamber 11 is kept at 600° C. Since the temperature in the heating chamber 11 decreases when the door 21 is opened for the steel member to be loaded, the temperature in the heating chamber 11 is raised up to the 600° C. nitriding process temperature by the heaters 25 while the introduction of the N2 gas and the NH3 gas at 30 L/min and 120 L/min is continued. At this time, the fan 26 is rotated at, for example, 1000 rpm in order for the inside of the heating chamber 11 to be uniformly heated.

After the temperature in the heating chamber 11 reaches the nitriding process temperature which is, for example, 600° C., a first nitriding process step is first performed in an atmosphere having a high nitriding potential KN in order to promote the initial generation of the nitride compound layer on the surface layer of the steel member. Note that the nitriding potential KN is expressed by the following well-known expression (1) using a ratio between a partial pressure P(NH3) of the NH3 gas and a partial pressure P(H2) of the H2 gas.

$$KN = P(NH_3)/P(H_2)^{3/2} \quad (1)$$

In the step of subjecting the steel member to the nitriding process, the partial pressure P(NH3) of the NH3 gas in the heating chamber 11 and the partial pressure P(H2) of the H2 gas are controlled to predetermined ranges. It is possible to control these gas partial pressures by analyzing the NH3 gas of the atmosphere in the heating chamber 11 by an infrared absorption method and analyzing the H2 gas by a high corrosion resistance thermal conductivity method, and while analyzing their analytic values online, automatically adjusting the flow rate of the H2 gas that is to be supplied to the heating chamber 11. For example, as indicated in FIG. 2, in the first nitriding process step, the NH3 gas introduced into the heating chamber 11 is set to 120 L/min and the flow rate of the H2 gas is adjusted, whereby the nitriding potential KN is controlled to a predetermined value. Then, the inside of the heating chamber 11 is heated by the heaters 25, and the steel member is subjected to the nitriding process while the temperature is kept at 600° C. for sixty minutes, for instance. The nitriding potential KN in the first nitriding process step is preferably 0.6 to 1.51.

After the first nitriding process step, a second nitriding process step to form the nitride compound layer having a desired phase mode is performed in an atmosphere whose nitriding potential KN is lowered. For example, as indicated in FIG. 2, in the second nitriding process step, the NH3 gas introduced into the heating chamber 11 is set to 60 L/min and the flow rate of the H2 gas is adjusted, whereby the nitriding potential KN is controlled to a predetermined value. Then, the inside of the heating chamber 11 is heated by the heaters 25, and the steel member is subjected to the nitriding process while the temperature is kept at 600° C. for sixty minutes, for instance. The nitriding potential KN in the second nitriding process step is preferably 0.16 to 0.25.

While the nitriding process is performed, the fan in the heating chamber 11 is rotated at, for example, 1800 rpm to uniformly diffuse the nitriding process gas. The nitriding process time indicated in FIG. 2 is an example and is not restrictive.

Incidentally, if the steel member is made of, for example, a carbon steel material for mechanical structure or an alloy steel material for mechanical structure, the temperature in the heating chamber 22 during the nitriding process is preferably kept at 520 to 610° C., though differing depending on the member to be treated. The higher the temperature of the nitriding process, the higher productivity is, but when the temperature is higher than 610° C., softening, an increase of strain, and the like may occur in the member to be treated. When it is lower than 520° C., a formation speed of the iron nitride compound layer becomes slow, which is not preferable in view of cost. Further, as a difference between the process temperatures in the first nitriding process step and the second nitriding process step is smaller, it is possible to perform the nitriding process with the smallest possible variation in temperature among members to be treated, which makes it possible to reduce variation in nitriding quality among the members to be treated. The temperature difference between the both process steps is preferably controlled to be within 50° C., and more preferably within 30° C., and still more preferably they are the same temperature.

When the second nitriding process step is finished, a cooling step is performed. FIG. 2 illustrates an example of a case where gas cooling is performed, and N2 gas for cooling is supplied into the process chamber. This gas cooling is performed for sixty minutes, for instance. Then, when the cooling is finished, the case 20 housing the steel member is unloaded to the unloading conveyor 13. In this manner, the nitriding process is finished. Incidentally, a cooling method in the cooling step may be not only the gas cooling or oil cooling illustrated in FIG. 1 but also air cooling, water cooling, or the like.

FIG. 3 illustrates modes of phases which are generated in the nitride compound layer depending on the nitriding potential KN and the process temperature, and the hatched range is a generation region of the nitride compound layer having a γ' phase and an ε phase. In the nitriding process step, in the first nitriding process, the temperature and the KN value are controlled to, for example, the A point in FIG. 3, which makes it possible to generate an ε+γ' phase in an initial period of the nitriding, and in the second nitriding process, the KN value is lowered while the temperature is kept constant so that the temperature and the KN value become the B point in FIG. 3, which makes it possible to transform the phase to the γ' phase in a latter period of the nitriding. Consequently, it is possible to reduce variation in the growth of the nitride compound in the steel member and in a lot and to obtain, for example, a 40% γ' phase or more. If the temperature or the KN value is lower than the nitride compound layer generation region illustrated in FIG. 3, it is not possible to form the nitride compound layer having the desired phase, and if the temperature or the KN value is too high, the γ' phase is not generated.

Alternatively, for example, in the first nitriding process step, the ε+γ' phase may be generated in the initial nitriding period under a lower temperature and a higher nitriding potential KN such as the C point in FIG. 3, and in the second nitriding process step, the phase may be transformed to the γ' phase in the latter period of the nitriding under an increased temperature and a decreased KN such as the B point in FIG. 3. In the first nitriding process step, either the γ' phase or the ε phase may be generated.

By the nitriding process being performed under the above condition, it is possible to obtain a nitrided steel member having, on its surface, the iron nitride compound layer whose main component is the γ' phase. The steel member thus obtained has increased strength with a nitrogen diffusion layer and a nitride being formed therein, and has sufficient pitting resistance and bending fatigue strength with the γ' phase-rich iron nitride compound layer being formed on its surface.

In the present invention, without performing the nitriding process under a low NH3 partial pressure ratio for a long time or without controlling the wind velocity as has been done in a conventional nitriding process method, the initial generation of the nitride compound layer is promoted by increasing the NH3 partial pressure ratio in the initial period of the nitriding process, and the mode of the nitride compound is controlled by thereafter performing the nitriding process under the decreased NH3 partial pressure ratio. Consequently, it is possible to produce the compound layer having a desired phase mode over the positions of the component to be treated uniformly and in a large amount, without any restriction of the wind velocity.

Further, as compared with carburizing and carbonitriding processes, the nitriding process of the present invention causes only a small strain amount since it is a process at an austenite transformation temperature or lower. Further, since a quenching step indispensable in the carburizing and carbonitriding processes can be dispensed with, a strain variation amount is also smaller. As a result, it is possible to obtain the nitrided steel member high in strength and low in strain.

Hitherto, a preferred embodiment of the present invention has been described, but the present invention is not limited to such an example. It would be obvious for those skilled in the art to think of various change examples or modification examples within the scope of the technical idea described in the claims, and these examples are naturally construed as being included in the technical range of the present invention.

EXAMPLES

Ring gears in a cylindrical shape and ring gears in a bottomed cylindrical shape which are steel members were used as treatment targets, and they were subjected to a nitriding process.

In an example 1 and a comparative example 1, the ring gears in the cylindrical shape were subjected to the nitriding process. An eight-tier jig was used, the number of the members loaded thereon was 320, and they were loaded in a flat manner. In the example 1, a nitriding process was performed in which the first nitriding process step is performed in an atmosphere of KN=1.03 for ten minutes, and the second nitriding process step was performed in an atmosphere of KN=0.24 for 110 minutes. In the comparative example 1, a nitriding process was performed in an atmosphere of KN=0.25 for 120 minutes. Conditions and results of the nitriding processes are presented in Table 1. Note that a temperature condition was set as indicated in FIG. 2.

TABLE 1

| | SOAKING 1 | | | | | | | SOAKING 2 | |
|---|---|---|---|---|---|---|---|---|---|
| ITEM | KN | $NH_3$ PARTIAL PRESSURE | $H_2$ PARTIAL PRESSURE | $N_2$ PARTIAL PRESSURE | TIME | $NH_3$ FLOW RATE (L/min) | $H_2$ FLOW RATE (L/min) | KN | $NH_3$ PARTIAL PRESSURE |
| EXAMPLE 1 | 1.03 | 0.31 | 0.45 | 0.24 | 10 min | 120 | — | 0.24 | 0.17 |
| COMPARATIVE EXAMPLE 1 | — | — | — | — | — | — | — | 0.25 | 0.18 |

TABLE 1-continued

| ITEM | SOAKING 2 $H_2$ PARTIAL PRESSURE | $N_2$ PARTIAL PRESSURE | TIME | $NH_3$ FLOW RATE (L/min) | $H_2$ FLOW RATE (L/min) | RESULT γ' RATIO | Cp(6σ) |
|---|---|---|---|---|---|---|---|
| EXAMPLE 1 | 0.79 | 0.04 | 110 min | 60 | 190 | 68% | 3.45 |
| COMPARATIVE EXAMPLE 1 | 0.81 | 0.01 | 120 min | 60 | 175 | 83% | 1.72 |

In the steel member subjected to the nitriding process by the present invention, the generated γ' phase-rich nitride compound layer preferably has a 4 to 16 μm thickness. When the thickness is less than 4 μm, fatigue strength is not improved sufficiently due to too small a thickness. On the other hand, when the thickness is over 16 μm, since a nitrogen diffusion speed in the γ' phase becomes slow, the nitrogen concentration in the γ' phase becomes high and a ratio of the ε phase increases, so that the whole nitride compound layer becomes brittle to be easily peeled off, and an improvement of the fatigue strength cannot be expected. A process capability index Cp(6σ) of the example 1 which was calculated when 4 to 16 μm in this preferable range were set as an upper limit value and a lower limit value turned out to be 3.45, which is far higher than that of the comparative example 1. The process capability index is process capability expressed as a numeric value, and is a value equal to a standard width divided by 6σ (σ: standard deviation). If Cp≥1.33, the process capability is sufficient, and 99.9% or more of products are up to standard.

In examples 2 to 8 and a comparative example 2, the ring gears in the bottomed cylindrical shape were subjected to a nitriding process. An eight-tire jig was used and the number of the members loaded thereon was 320, and they were loaded with their bottoms downward. In the examples 2 to 8, a flow rate of NH3 gas was set to 120 L/min and 60 L/min in the first nitriding process step and the second nitriding process step respectively, and a flow rate of H2 gas was adjusted, whereby KN was controlled to fall within a 0.60 to 1.51 range in the first nitriding process step, and KN was controlled to fall within a 0.16 to 0.25 range in the second nitriding process step. The first and second nitriding process steps in the examples 2 to 8 were performed for 60 minutes each. In the comparative example 2 as in the comparative example 1, the nitriding process was performed in an atmosphere of KN=0.25 for 120 minutes. Conditions and results of the nitriding processes are presented in Table 2. Note that a temperature condition was set as in FIG. 2.

TABLE 2

| ITEM | SOAKING 1 KN | $NH_3$ PARTIAL PRESSURE | $H_2$ PARTIAL PRESSURE | $N_2$ PARTIAL PRESSURE | TIME | $NH_3$ FLOW RATE (L/min) | $H_2$ FLOW RATE (L/min) | SOAKING 2 KN | $NH_3$ PARTIAL PRESSURE |
|---|---|---|---|---|---|---|---|---|---|
| EXAMPLE 2 | 0.60 | 0.2 | 0.48 | 0.32 | 60 min | 120 | ADJUST | 0.25 | 0.18 |
| EXAMPLE 3 | 0.70 | 0.24 | 0.49 | 0.27 | 60 min | 120 | ADJUST | 0.25 | 0.18 |
| EXAMPLE 4 | 0.81 | 0.26 | 0.47 | 0.27 | 60 min | 120 | ADJUST | 0.16 | 0.13 |
| EXAMPLE 5 | 1.03 | 0.29 | 0.43 | 0.28 | 60 min | 120 | ADJUST | 0.25 | 0.18 |
| EXAMPLE 6 | 1.51 | 0.34 | 0.37 | 0.29 | 60 min | 120 | ADJUST | 0.21 | 0.15 |
| EXAMPLE 7 | 0.65 | 0.22 | 0.49 | 0.29 | 60 min | 120 | ADJUST | 0.25 | 0.18 |
| EXAMPLE 8 | 0.75 | 0.25 | 0.48 | 0.27 | 60 min | 120 | ADJUST | 0.20 | 0.14 |
| COMPARATIVE EXAMPLE 2 | — | — | — | — | — | — | — | 0.25 | 0.18 |

| ITEM | SOAKING 2 $H_2$ PARTIAL PRESSURE | $N_2$ PARTIAL PRESSURE | TIME | $NH_3$ FLOW RATE (L/min) | $H_2$ FLOW RATE (L/min) | RESULT γ' RATIO | Cp(6σ) |
|---|---|---|---|---|---|---|---|
| EXAMPLE 2 | 0.81 | 0.01 | 60 min | 60 | ADJUST | 46% | 2.08 |
| EXAMPLE 3 | 0.81 | 0.01 | 60 min | 60 | ADJUST | 51% | 1.63 |
| EXAMPLE 4 | 0.86 | 0.01 | 60 min | 60 | ADJUST | 46% | 1.57 |
| EXAMPLE 5 | 0.81 | 0.01 | 60 min | 60 | ADJUST | 51% | 2.53 |
| EXAMPLE 6 | 0.79 | 0.06 | 60 min | 60 | ADJUST | 62% | 2.27 |
| EXAMPLE 7 | 0.81 | 0.01 | 60 min | 60 | ADJUST | 40% | 2.82 |
| EXAMPLE 8 | 0.78 | 0.08 | 60 min | 60 | ADJUST | 59% | 2.00 |
| COMPARATIVE EXAMPLE 2 | 0.81 | 0.01 | 120 min | 60 | ADJUST | 83% | 0.81 |

In all of the examples 2 to 8, it was possible to obtain a 40% γ' phase or more, and a process capability index Cp(6σ) fell within a 1.57 to 2.82 range. On the other hand, in the comparative example 2, a thickness variation of the compound layer in a lot was not up to standard, and the products were of no industrial value. Further, in the comparative example 1, since the rings have a simple shape, a wind velocity in a furnace was sound, but the examples of the present invention have higher industrial reliability.

As described above, according to the examples of the present invention, it was possible to obtain nitrided steel members which were strengthened with a nitrogen diffusion layer and a nitride being formed in each of them, and which had sufficient pitting resistance and bending fatigue strength with a γ' phase-rich iron nitride compound layer being formed on a surface of each of them. Further, since the nitriding process is performed at an austenite transformation temperature or lower, a strain amount is small, and in addition since a quenching step can be dispensed with, a strain variation amount is also small. Therefore, by carrying out the present invention, it was possible to obtain a nitrided steel member high in strength and low in strain.

INDUSTRIAL APPLICABILITY

The present invention is useful for steel nitriding technology.

EXPLANATION OF CODES

1 heat treatment apparatus
10 loading unit
11 heating chamber
12 cooling chamber
13 unloading conveyor
20 case
21 door
22 entrance hood
26 fan
30 elevator
31 oil
32 oil tank
35 door
36 exit hood

The invention claimed is:

1. A nitriding process method of a steel member, wherein a first nitriding process step is performed in which the steel member is subjected to a nitriding process in a nitriding gas atmosphere having a nitriding potential with which a nitride compound layer having a γ' phase or an ϵ phase is generated, and thereafter a second nitriding process step is performed in which the steel member is subjected to a nitriding process in a nitriding gas atmosphere having a nitriding potential lower than the nitriding potential in the first nitriding process step, to thereby further precipitate γ' phase in the nitride compound layer, and wherein the first nitriding step is performed in a nitriding gas atmosphere having a 0.6 to 1.51 nitriding potential, and the second nitriding process step is performed in a nitriding gas atmosphere having a 0.16 to 0.25 nitriding potential.

2. The nitriding process method of the steel member according to claim 1, wherein, in the first nitriding process step, the nitriding potential is controlled to 0.6 to 1.51 by introducing $NH_3$ gas to a heating chamber where the nitriding process is performed and adjusting a flow rate of $H_2$ gas, and wherein, in the second nitriding process step, the nitriding potential is controlled to 0.16 to 0.25 by introducing the $NH_3$ gas at a flow rate lower than the flow rate in the first nitriding process step to the heating chamber where the nitriding process is performed and adjusting a flow rate of the $H_2$ gas.

3. The nitriding process method of the steel member according to claim 2, wherein temperatures in the heating chamber in the first nitriding step and the second nitriding step are kept at 520 to 610° C.

4. The nitriding process method of the steel member according to claim 3, wherein a difference between the temperatures in the first nitriding step and the second nitriding step is within 50° C.

5. The nitriding process step of the steel member according to claim 4, wherein the temperatures in the first nitriding step and the second nitriding step are equal to each other.

* * * * *